United States Patent [19]

Yoshida

[11] Patent Number: 4,580,351

[45] Date of Patent: Apr. 8, 1986

[54] SCALE BALANCING DEVICE IN UNIVERSAL PARALLEL RULER DEVICE

[76] Inventor: Yasutomo Yoshida, c/o Mutoh Industry Ltd. 3-I-3, Ikejiri, Setagaya-ku, Tokyo, Japan

[21] Appl. No.: 689,896

[22] Filed: Jan. 9, 1985

[51] Int. Cl.[4] ..... B43L 13/02

[52] U.S. Cl. ..... 33/438; 33/439; 33/440

[58] Field of Search ..... 33/438, 430, 439, 440, 33/448

[56] References Cited

U.S. PATENT DOCUMENTS 4,070,758 1/1978 Watanabe ..... 33/438

*Primary Examiner*—Willis Little

*Attorney, Agent, or Firm*—Wenderoth, Lind & Ponack

[57] ABSTRACT

A scale balancing device for balancing the weight of a scale of a universal parallel ruler, having a head structure having a rotating scale support rotatably mounted thereon on which the scales are carried, the scale support and scales having a center of gravity when the scale is horizontal spaced horizontally from the axis of rotation of the scale support, a rotating member rotatably mounted on the head structure separate from the rotating support, the rotating member and the scale support being rotatably interlocked, an eccentric member on the rotating member, a spring member having one end connected to the eccentric member and the other end connected to the head structure and tensioned for providing a torque on the rotating member in a direction which substantially cancels out the torque on the rotating member from the weight of the scales, the point of interlocking of the rotating member and the scale support being on the side of the scale support toward the center of gravity when the scale is in the horizontal position for causing the point of action of the torque from the rotating member to act upwardly at a point toward the center of gravity from the axis of rotation of the scale support.

3 Claims, 19 Drawing Figures

SCALE BALANCING DEVICE IN UNIVERSAL PARALLEL RULER DEVICE

BRIEF SUMMARY OF THE INVENTION

This invention relates to a scale balancing device in universal parallel ruler device wherein a scale is caused to be set in a freely rotatable condition relative to a non-rotating member of a head on an inclinable drawing board whereby the scale is not rapidly rotated in a downward direction due to an inclination of the drawing board to maintain the scale in a stable and static condition.

Scale balancing devices in a universal parallel ruler device are available in various types, but the devices are classified roughly into a balance weight system and an eccentric cam system. The balance weight system is one in which the weight of a balance weight is caused to work in a direction opposite to the rotating direction on a member interlocked with the rotation of a scale in a downward dropping direction to balance the scale by the action of the weight. A balancing device of this type is disclosed in the publications, for example, the Japanese Utility Model Publication No. 47-9478, Japanese Patent Publication No. 57-47040, Japanese Patent Publication No. 57-49399 and Japanese Patent Publication No. 58-4640. On the other hand, the eccentric cam system is one in which a spring is caused to work on an eccentric cam interlocked within the rotation of a scale, and a rotatory torque is generated on the eccentric cam by the elastic force of the spring in a direction opposite to the rotating direction of the scale due to the weight of the scale to balance the scale. A balancing device of the eccentric cam system type is disclosed in the Japanese Utility Model Publication No. 52-28605.

The balancing weight system has a drawback, for example, that the weight becomes heavy due to the use of the balance weight and also the manual rotation of the scale by the inertia force of the balance weight becomes difficult. The eccentric cam system has a drawback, for example, the frictional force is generated on an elastic contact portion of the spring and the eccentric cam whereby the manual rotation of the scale by the frictional force becomes difficult.

A primary object of this invention is to provide a scale balancing device which does not use a balance weight and an eccentric cam, and the scale is maintained in a balanced condition by connecting a spring member to a rotating member that rotates by interlocking with the scale, whereby the scale can be rotated by a light manual operation.

Another object of this invention will be described in the following by referring to FIG. 17.

When the drawing board is tilted in a vertical direction, the rotatory torque in clockwise direction centering around the tubular member 20 rotatably mounted on a spindle 22 is generated by the total weight of the rotating member 60 and the scale 52 connected to the rotating member 60 acting on the spindle 22 to which the rotating member 60 is fixed. This rotatory torque becomes a maximum condition when the scale 52 is in the zero degree position. If the rotating member 60 is balanced by canceling this rotatory torque out, the load working between the spindle 22 and the tubular member 20 becomes zero if the center of gravity G of the overall structure and which is to the side of the rotating member 60 is supported. However, as a practical problem, the supporting of the position of center of gravity to the side of the rotating member 60 is difficult from a design standpoint. Under this circumstance, if a position in the vicinity of the point of center of gravity on the outer periphery of the rotating member 60, for example, a point is supported, the pressure load between the spindle 22 and the tubular member 20 can be decreased. As shown in FIG. 17*c*, if a point J is supported which is at a position the most remote from the center of gravity G on the outer periphery of the rotating member 60, a large load acts between the spindle 22 and the tubular member 20 due to the rotatory torque on the rotating member 60.

An object of this invention is to decrease the pressure load between the spindle and the tubular member by placing an engaging point of a second rotating member with the rotating member 60 at a position in the vicinity of the point of center of gravity to the side of the rotating member.

DESCRIPTION OF THE PREFERRED EMBODIMENT

The construction of this invention will be described in detail in the following by referring to an embodiments illustrated in the attached drawings.

Figure 1:
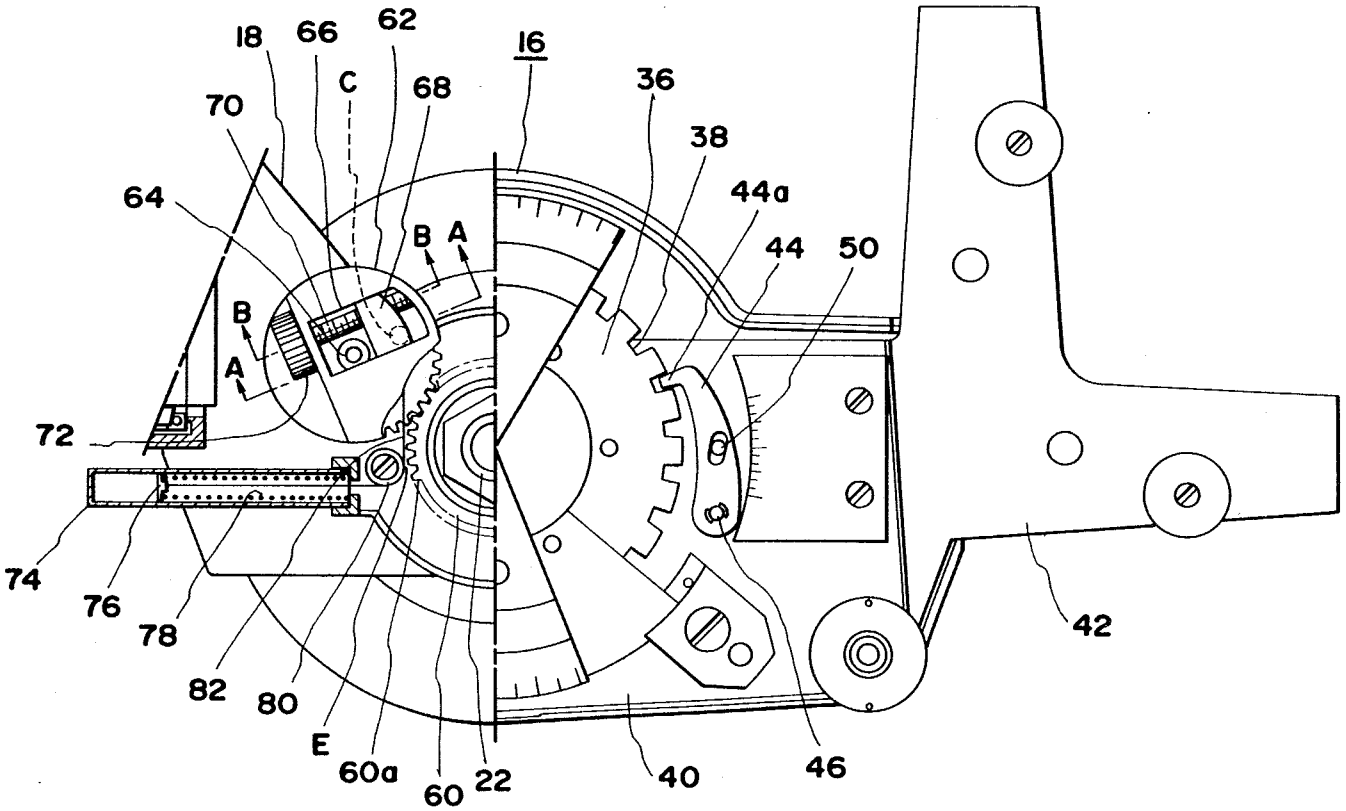
FIG. 1 is a plan view of an embodiment of a scale balancing device with the cover of a head removed.
Figure 2:
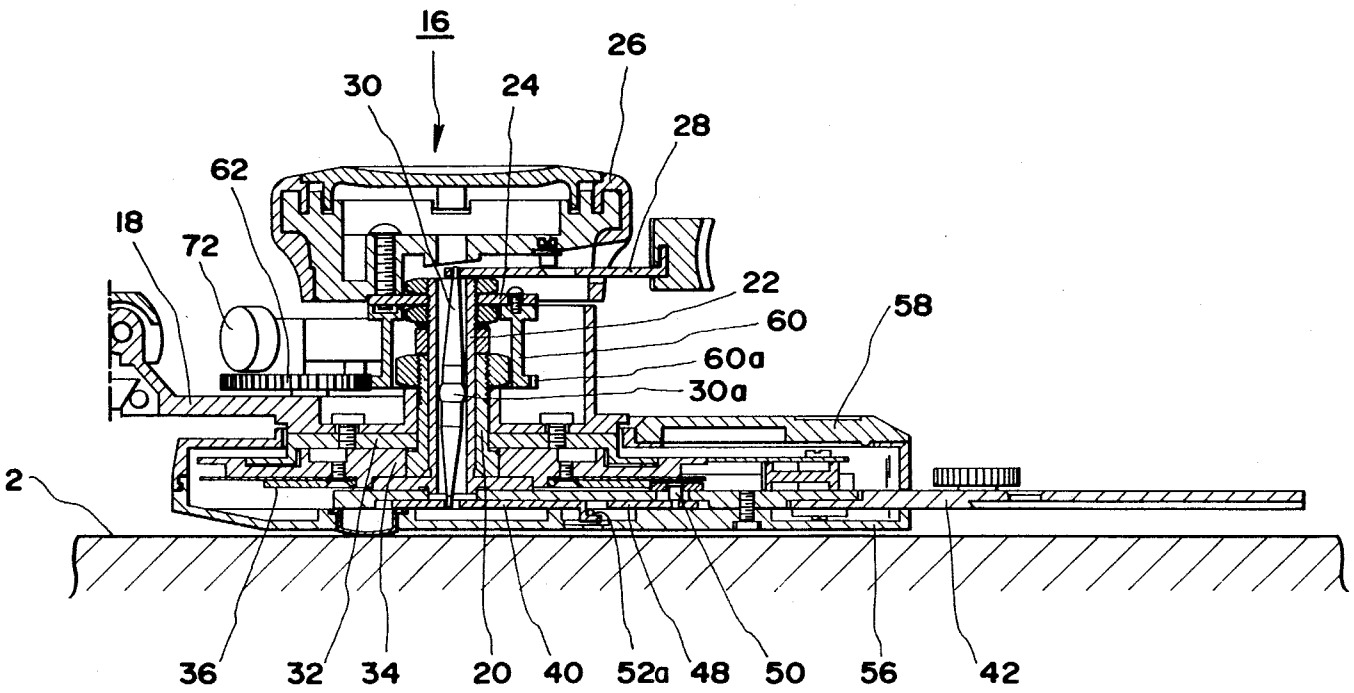
FIG. 2 is a cross section of the head of the embodiment of FIG. 1.
Figure 3:
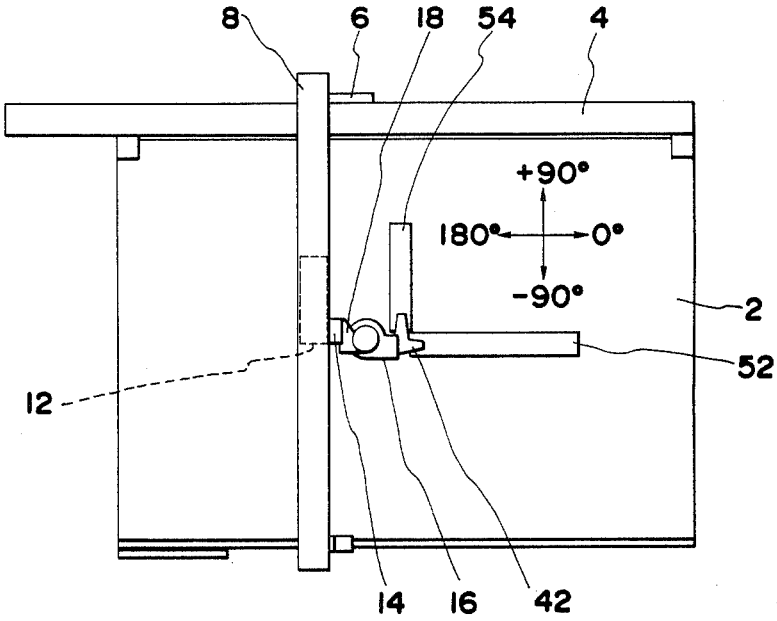
FIG. 3 is an elevation of an entire universal parallel ruler device.
Figure 4:
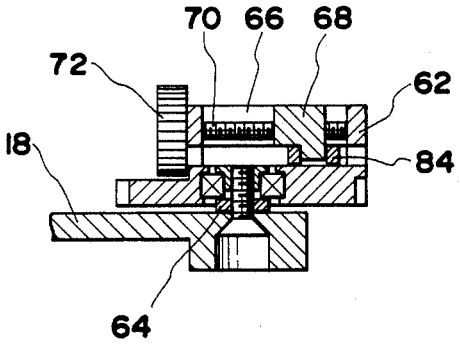
FIG. 4 is a cross section taken on line A—A in FIG. 1.
Figure 5:
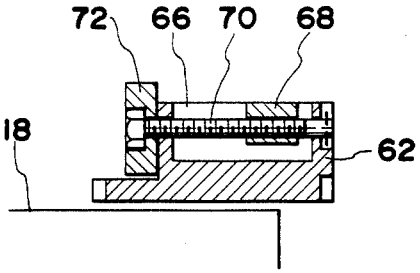
FIG. 5 is a cross section taken on line B—B in FIG. 1.

In FIG. 3, numeral 2 denotes the drawing board, which is supported on a support frame of a drawing stand (not shown) capable of being tilted and fixed at any desired angle. Numeral 4 denotes a horizontal rail disposed on the upper side of the drawing board 2, and a horizontal cursor 6 is shiftably mounted on the horizontal rail 4. The upper end of a vertical rail 8 is connected to the horizontal cursor 6. The lower end of the vertical rail 8 is shiftably mounted on the drawing board 2 by means of a tail portion roller (not shown). Numeral 12 denotes a vertical cursor mounted shiftably on the vertical rail 8, and the vertical cursor has mounted thereon to a support base plate 18 of a head 16, namely, a non-rotating member by means of a known double hinge mechanism 14. As shown in FIG. 2, the tubular member 20 is fixed to a tubular portion of the support base plate 18 by means of nut. Numeral 22 denotes a tubular spindle, and the outer peripheral surface of the spindle is rotatably inserted into the interior of the tubular member 20 in engagement with the inner peripheral surface thereof, and a mounting plate 24 is fixed to an upper portion of the spindle 22 by means of nut. A grip handle 26 is fixed to the mounting plate 24. Numeral 28 denotes an index lever, and its one end portion is connected to the upper end of a conical bar 30 disposed in the interior of the spindle 22. Numeral 32 denotes a stationary board fixed to the support base plate 18, and numeral 34 denotes a protractor rotatably fitted to an outer peripheral surface of a flange portion of the tubular member 20, and the protractor 34 is fixed to the stationary board 32 by means of a stationary mechanism (not shown) capable of being released. Numeral 36 denotes an index ring fixed to the protractor 34, and concave index recesses 38 are formed in the outer peripheral surface of the index ring 36 at predetermined intervals. Numeral 40 denotes a base plate fixed to the flange portion of the spindle 22, and a scale mounting plate 42 is mounted on the base plate 40. Numeral 44 denotes a swing arm whose one end portion is pivotally supported on the base plate 40 by means of a shaft 46, and a pawl portion 44*a* of the swing arm 44 is fitted into one of the index recesses 38 (refer to FIG. 1). One end of a transmitting member 48 is connected to the lower end of the conical bar 30, and a shaft 50 fixed to the other end of the transmitting member 48 is fitted in a long groove formed in the swing arm 44. The transmitting member 48 is urged in a leftward direction in FIG. 2 by means of a spring member 52*a*. The index lever 28, conical bar 30, index ring 36, swing arm 44, and a transmitting member 48 constitute means for fixing the base plate 40 to the protractor 34 and releasing the protractor 34 from the base plate 40. Scales 52 and 54 are detachably fixed to the scale mounting plate 42 as shown in FIG. 3. Numeral 56 denotes a bottom portion cover fixed to the base plate 40, and numeral 58 denotes an upper portion cover mounted on the cover 56. The support base plate 18, stationary board 32, protractor 34, index ring 36 and tubular member 20 constitute a non-rotating portion of the head. Numeral 60 denotes a rotating member composed of a tubular member fixed to the mounting plate 24, and teeth 60*a* are provided on a lower portion of the rotating member 60. The center of rotation of the teeth 60*a* and the center of the spindle 22 are coaxial. Numeral 62 denotes a second rotating member formed of a gear rotatably and pivotally supported at 64 on the support base plate 18, and the rotating member 62 is meshed with the teeth 60*a*. In FIG. 1, numeral 66 denotes a guide groove extending lengthwise in a radial direction of the gear 62, and an element 68 is slidably disposed in the guide groove for movement in a longitudinal direction along the guide groove 66. Numeral 70 denotes a threaded shaft rotatably and pivotally supported on the rotating member 62, and a threaded hole in the element 68 is threaded on the shaft 70. One end of the shaft 70 has a knob 72 thereon. Numeral 74 denotes a cylinder having one end open and fixed to the support base plate 18, and a disc member 76 is slidable in the cylinder 74. Numeral 78 denotes a coil spring compressed and disposed in the cylinder 74, and its one end is elastically contacted with the disc member 76. Numeral 80 denotes a rope guide in the form of a rope pulley rotatably and pivotally supported on the support base plate 18, and a wire rope 82 having pliability and flexibility is reeved around the rope guide 80. One end of the rope 82 is connected to the disc member 76. The other end of the rope 82 is fixed to a metal terminal 84, and the metal terminal 84 is connected to a projection on the member 68. When the terminal 84 is positioned at a rope control point E of the rope guide 80, an initial zero position of the spring 78 is set so that the tension on the rope 82 from the spring 78 is zero, and also, a spring 78 is employed which has spring constant corresponding to weights of the base plate 40, scale mounting plate 42 and scales 52 and 54. The head 16 is so constructed that it will be static at an optional position on the inclined drawing board 2 by a known head balancing device (not shown).

The operation of the embodiment of this invention will be described in the following.

In the first place, the drawing board 2 is set at a desired angle relative to the floor level. When pressure is applied to the handle 26 of the head 16 in an optional direction in parallel to the surface of the drawing board 2, the head 16 can be parallelly shifted to a desired location on the drawing board 2. When the index lever 28 is manually shifted in a left direction in a condition where the head 16 is static at an optional position on the drawing board 2, the conical bar 30 is swung in a counterclockwise rotating direction in FIG. 2 with a bulged portion 30*a* of the bar 30 as its fulcrum and the transmitting member 48 is shifted in the rightward direction. Thus, the swing arm 44 is swung in a clockwise rotating direction in FIG. 3 with the shaft 46 as its center, and its pawl portion 44*a* is separated from the recess 38 of the index ring, and the scale mounting plate 42 becomes freely rotatable around the tubular member 20. Namely, the fixing of the scale mounting plate 42 relative to the non-rotating member is released. In this condition, a rotatory torque T′ is generated on the spindle 42 by the weight of the base plate 40, scale mounting plate 42 and scales 52 and 54. This rotatory torque T′ is transmitted to the second rotating member 62 by means of the rotating member 60. The magnitudes of the rotatory torque T′ and the rotatory torque T working on the second rotating member 62 are almost identical, and the torques are in opposite directions. Accordingly, the scales 52 and 54 are static on the drawing board 2 even if they are in a free rotating condition, and no rapid rotation due to the weight occurs. When the scale 52 is rotated until it becomes almost parallel upwardly to the vertical rail 8, namely, to almost +90 degrees, the rotatory torque of the rotating member 60 due to the weight of the scales 52 and 54 becomes zero. The terminal 84 at this time approaches most closely to the rope guide 80, and the so called radius R of rotation on the rotatory torque generating element of the second rotating member 62 due to the spring 78 becomes zero. When the scale 52 is rotated to almost −90 degrees, the rotatory torque of the rotating member 60 due to the weight of the scales 52 and 54 again becomes zero. The terminal 84 at this time is separated the farthest from the rope guide 80, and the rope 82 is positioned in line with the rotation center of the shaft 64 of the second rotating member 62, and the tensile force of the spring 78 becomes the largest. However, this tensile force is supported at the side of the non-rotating member by the shaft 64, and there is no chance for the tensile force to work on the rotating member 60.

The operation of adjusting the radius R of the rotation will be described in the following.

When the knob 72 is rotated, the shaft 70 is rotated. By this movement, the member 68 is shifted along the guide groove 66, and the rope terminal 84 is shifted in its radial direction on the rotating member 62 by being interlocked with the member 68. The distance of the rope connection point C from the center of the rotation of the rotating member 62 is changed by the shifting of the rope terminal 84. The value of the load W applied on the base plate 40 by the weight of the scale is changed according to a change of the inclination angle of the drawing board. Accordingly, when the inclination angle of the drawing board 2 is changed, the knob 72 is rotatably adjusted so that the magnitude of the rotatory torque T generated on the rotating member 62 by the tensile force of the spring 78 can be caused to coincide with the magnitude of the rotatory torque T' generated on the rotating member 62 by the load W.

Figure 6:
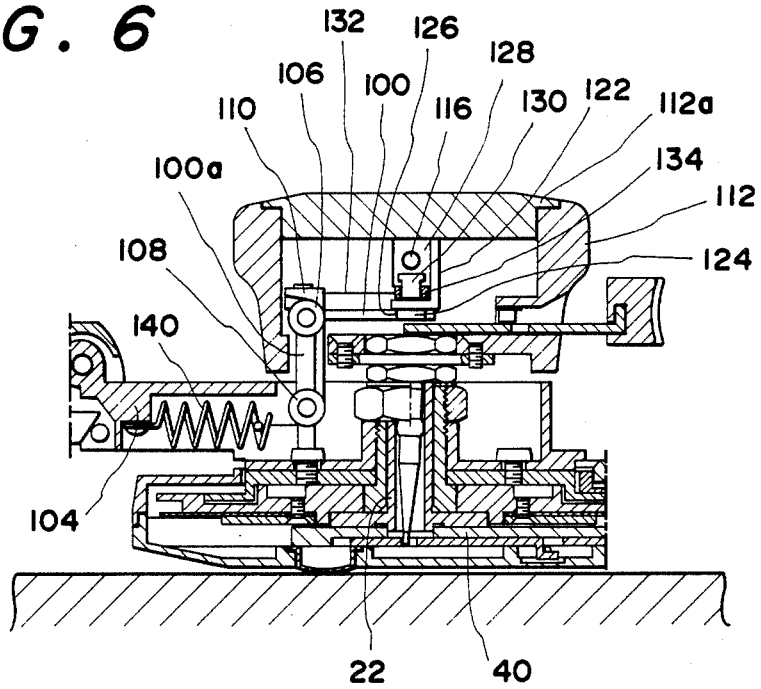
FIG. 6 is a cross section of a head illustrating a second embodiment of a scale balancing device.
Figure 7:
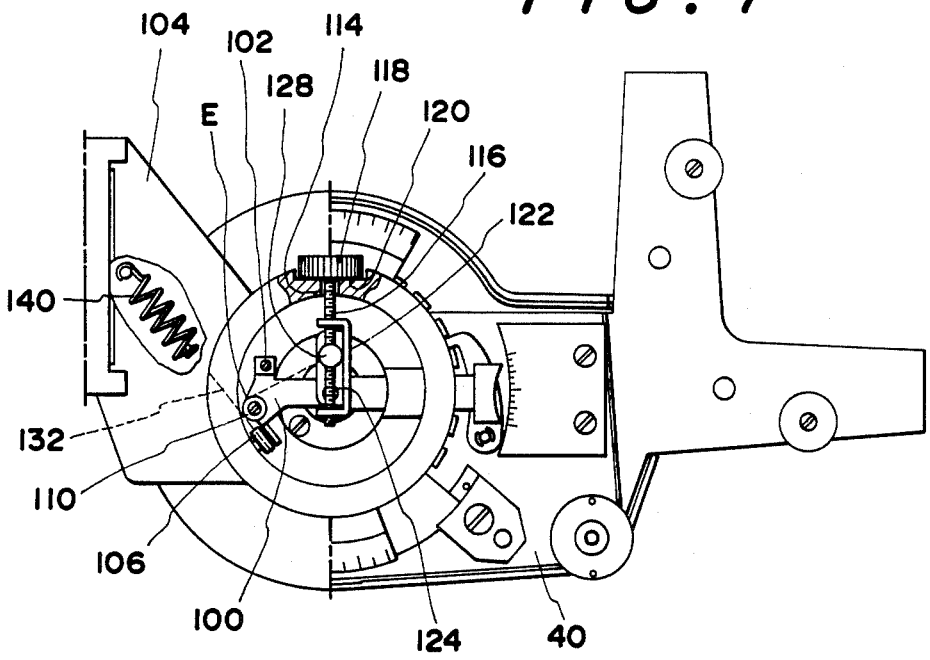
FIG. 7 is a plan view of the head shown in FIG. 6.

Another embodiment will be described in the following by referring to FIG. 6 and FIG. 7.

Figure 8:
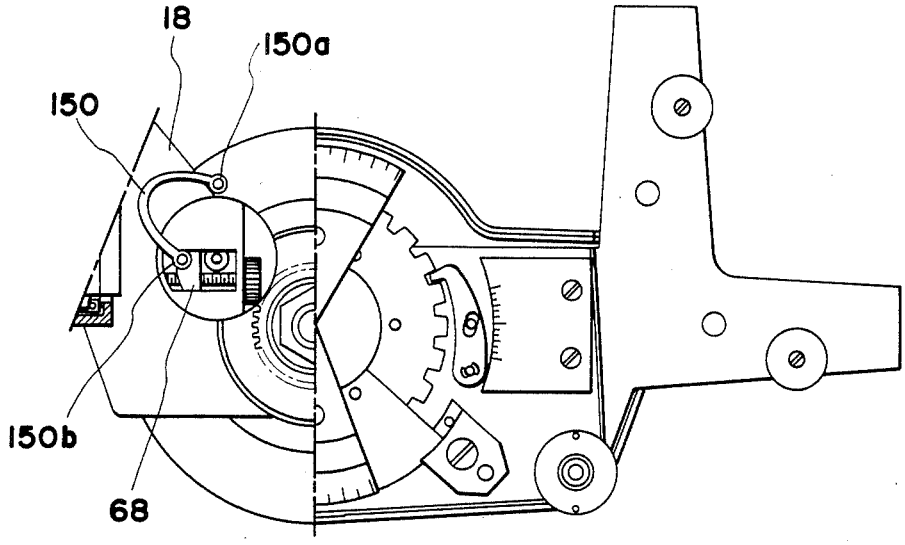
FIG. 8 is a plan view of the head of a third embodiment of a scale balancing device.
Figure 9:
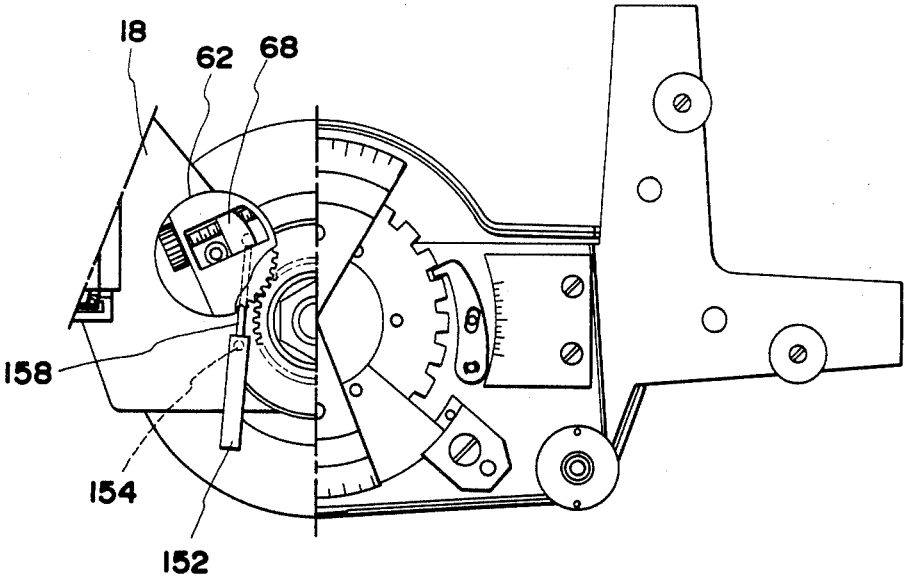
FIG. 9 is a plan view of the head of a fourth embodiment of a scale balancing device.
Figure 10:
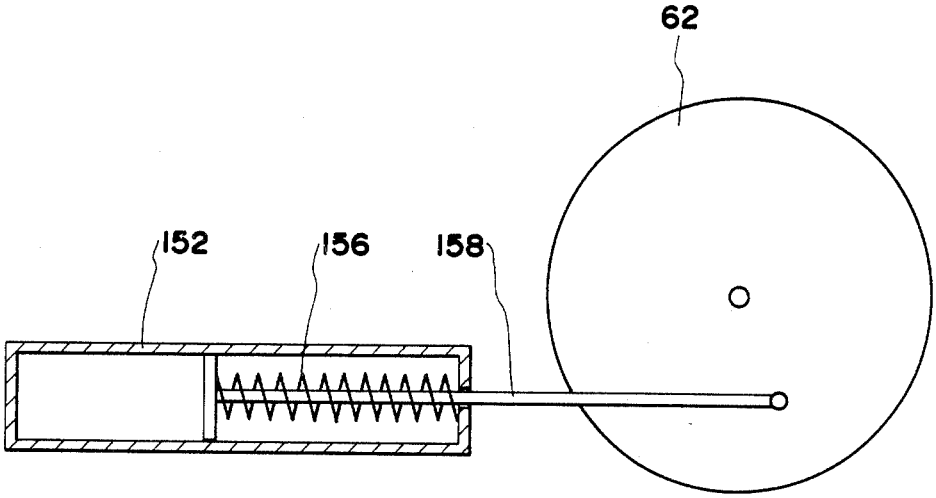
FIG. 10 is an explanatory drawing of a part of the fourth embodiment.
Figure 11:
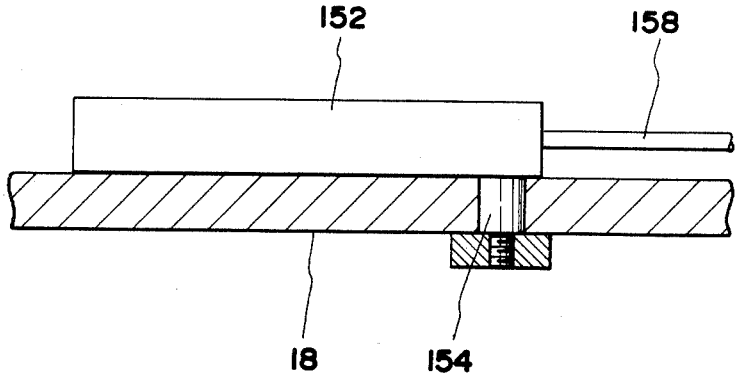
FIG. 11 is an elevation view of the part shown in FIG. 10.

Numeral 100 denotes a bracket, and the lower end of a perpendicular portion 100*a* is fixed to a support base plate 104 by a screw 102. At upper and lower ends of the perpendicular portion 100*a*, vertical rope pulleys 106 and 107 are rotatably journaled. The upper end of the perpendicular portion 100*a* is adjacent to the rope pulley 106, and a rope guide 110 made of a horizontal rope pulley is rotatably journaled thereon. Numeral 116 denotes a threaded shaft rotatably inserted into a horizontal hole 114 bored in the side wall of a handle 112 (rotating member) in a radial direction, and one end of the screw lever 116 has a knob 118 fixed thereto. One surface of the knob 118 abuts rotatably in a recess portion 120 formed in the handle 112. Numeral 122 denotes a second rotating member constituted by a frame member, and the shaft 116 is rotatably inserted into holes bored in a pair of side walls of the second rotating member. The rotatory torque of the rotating member 122 is transmitted only to the handle 112 (rotating member) by means of a shaft 116 by this construction. A disc like projection 124 projecting from the bottom wall of the rotating member 122 is fitted rotatably in a hole 126 bored in the horizontal portion of the bracket 100. The center of the hole 126 is coaxial with the center of the rotation of the handle 112. The upper end of the rotating member 122 abuts the lower surface of the cap 112*a* of the handle 112. Numeral 128 denotes an element threaded on shaft 116, and a shaft 130 is fixed to the lower end of the element 128, and a terminal 134 of a wire rope 132 is fitted on the shaft 130. The shaft 116 is so constructed that it does not shift in the axial direction thereof relative to the rotating member 122. The lower end of the shaft 130 abuts slidably on the upper surface of the horizontal portion of the rotating member 122, and one side and the upper surface of the element 128 abut slidably on the side of the perpendicular portion of the rotating member 122 and the lower surface of the cap 112*a* of the handle 112. Numeral 140 denotes a coil spring whose one end portion is secured by a screw to the support base plate 104, and one end of the flexible wire rope 132 having a flexibility is connected to the other end portion of the coil spring. The wire rope 132 is reeved around the pulleys 108 and 106 and the rope guide 110, and the terminal 134 is connected to the other end thereof. The internal structure of the head is identical with the internal structure of the head illustrated in FIG. 2 so that the description thereof is omitted. In the foregoing construction, when the center point of the hole of the terminal 134 is closest to the rope control terminal E of the rope guide, the tensile force of the spring 140 is set to be zero. Also, the setting is made when the handle 112 of the head is rotated until the scale 52 becomes almost parallel to the vertical rail 8 (refer to FIG. 1) in a counterclockwise rotating direction in FIG. 7 on the inclined drawing board, and the rotatory torque T' generated in the handle 112 due to the weight of the scales 52 and 54 is zero, the terminal 134 approaches most closely to the rope guide 106, and the radius R of rotation of the rotatory torque generating element on the handle 112 due to the spring 140 becomes zero. The rotatory torque T' generated in a clockwise rotating direction in FIG. 7 on the spindle 22 by the weight of the scale and the scale mounting plate is transmitted to the handle 112 (rotating member). On the other hand, the tensile force of the spring 140 is transmitted to the handle 112 by means of the rope 132, element 128, and shaft 116, and the rotatory torque T is generated in a counterclockwise rotating direction in FIG. 7 on the handle 112 by the tensile force of the spring 140. In the condition where the drawing board is fixed at a predetermined inclination angle, the magnitudes of the rotatory torques T and T' are set identically, and when the scale is in a free condition, it is static on the inclined drawing board, and remains in complete balance. When the inclination angle of the drawing board is changed, the magnitude of the rotatory torque T' is changed. In this case, the knob 118 is rotated, and the element 128 is shifted in the radial direction of the handle 112 along the shaft 116, and the magnitude of the rotatory torque T' is made to coincide with the magnitude of the rotatory torque T. When the rotating member 112 is rotated until the scale 52 is at almost −90 degrees, and the tensile force of the spring 140 becomes a maximum on the second rotating member 122, this tensile force is supported by the bracket 100, and the tensile force of the spring 140 does not work on the rotating member 112. In the embodiment shown in FIG. 8, one end 150*a* of the bent spring 150 is rotatably mounted on the support base plate 18, and the other end 150*b* is rotatably mounted on the element 68 and the tension is so set that the elastic force becomes zero when both the end portions 150*a* and 150*b* are superposed. Also, as shown in FIG. 9 through FIG. 11, a cylinder 152 is rotatably journaled at 154 on the support base plate 18, and the tip of a rod 158 urged by a coil spring 156 is rotatably connected to the element 68 and the second rotating member 62 is urged in a counterclockwise direction in FIG. 9 by the tensile force on the rod 158. In this construction, when the tip of the rod 158 is shifted to the center of rotation of the cylinder 152, the initial elastic force of the spring 156 is set so that the elastic force of the coil spring 156 becomes zero.

Figure 12:
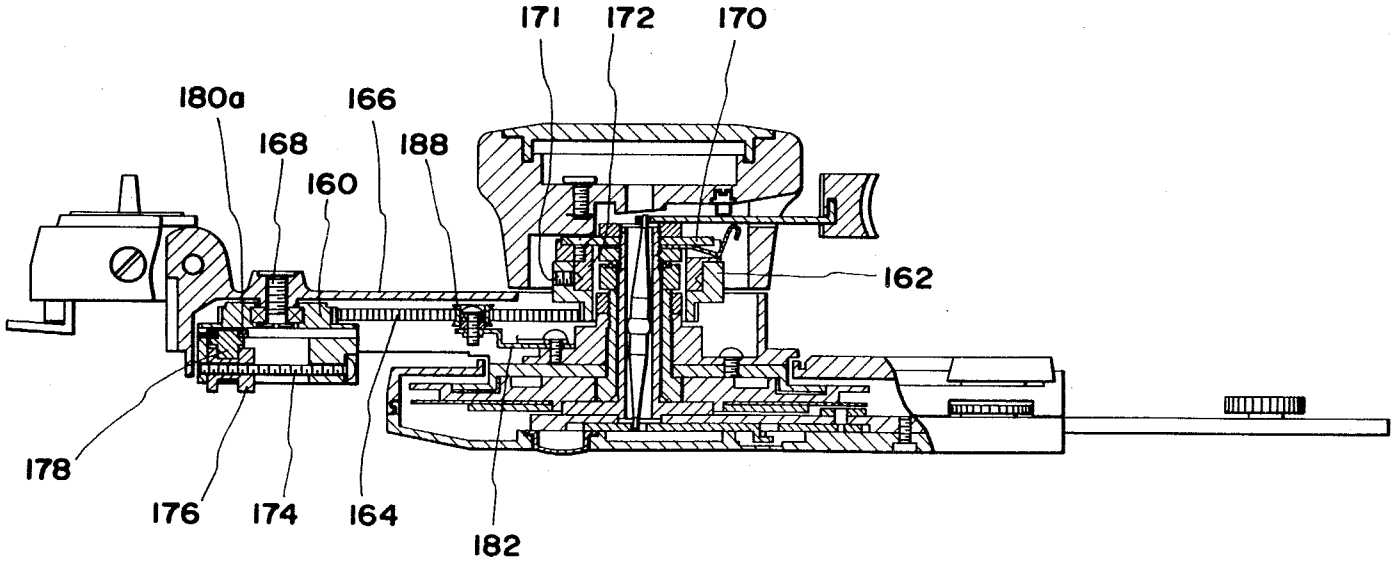
FIG. 12 is a cross section of a head according to a first embodiment of this invention.
Figure 13:
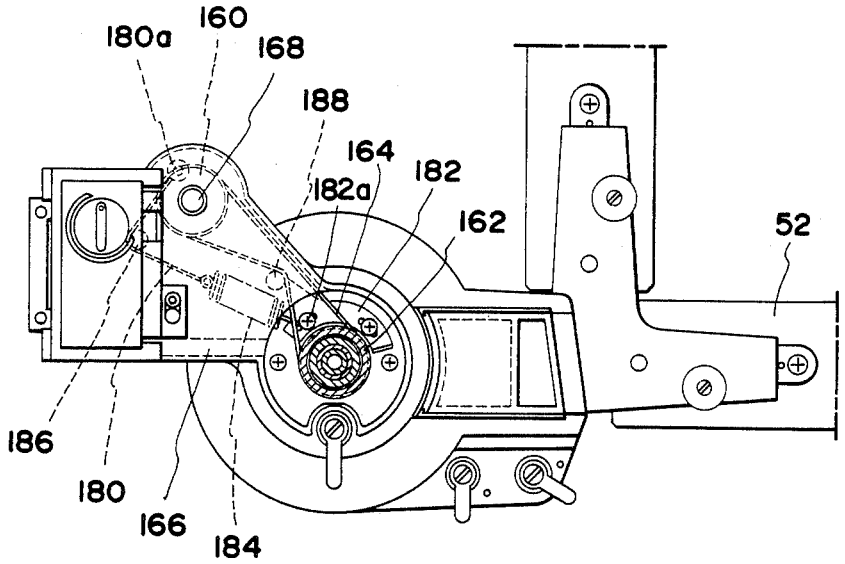
FIG. 13 is a plan view, partly in cross section, of the head of FIG. 12.

In the embodiment of the scale balancing device as shown in FIG. 12 and FIG. 13, pulley portions for a timing belt are formed on the second rotating member 160 and the first rotating member 162, and the portion between the pulley portions may be connected by an endless timing belt 164. Instead of the timing belt, ordinary belts may be used. The second rotating member 160 is rotatably journaled at 168 on the support base plate 166, and the rotating member 162 is fixed to a cylinder 172 fixed to a mounting plate 170by means of screws. An element 176 is threaded on a threaded shaft 174 rotatably journaled on the rotating member 160, and when the shaft 174 is rotated, the element 176 is shifted along the shaft 174. A projection 178 is rotatably fitted on the element 176, and metal terminal 180*a* of a rope 180 is fitted on the projection 178. Numeral 182 denotes a bracket fixed to the support base plate 166 by screw 182*a*, and one end of a coil spring 184 is engaged with the screw and the other end of the coil spring 184 is connected to one end of the wire rope 180. The other end of the wire rope 180 is connected to the element 176 by means of the metal terminal 180*a*. Numeral 186 denotes a rope guide constituted by a pulley mounted rotatably on the support base plate 166, and numeral 188 denotes a belt guide pulley mounted rotatably on the bracket 182. The internal construction of the head of this embodiment is almost identical with the construction of the head illustrated in FIG. 2 so that the description there of is omitted.

In the foregoing construction, the rotatary torque generated in the counterclockwise rotating direction in FIG. 13 on the rotating member 162 by the weight of the scale is transmitted to the second rotating member 160 by means of the timing belt 164, and this rotatory torque is canceled out by the rotatory torque due to the tensile force of the spring 184. A maximum tensile force of the spring 184 is supported by the fulcrum 168 of the second rotating member 160, and is not transmitted to the rotating member 162. An adjustment of the torque on the second rotating member 160 can be carried out by rotating the shaft 174 and shiftably adjusting the element 176 in the radial direction of the rotating member 160.

Figure 14:
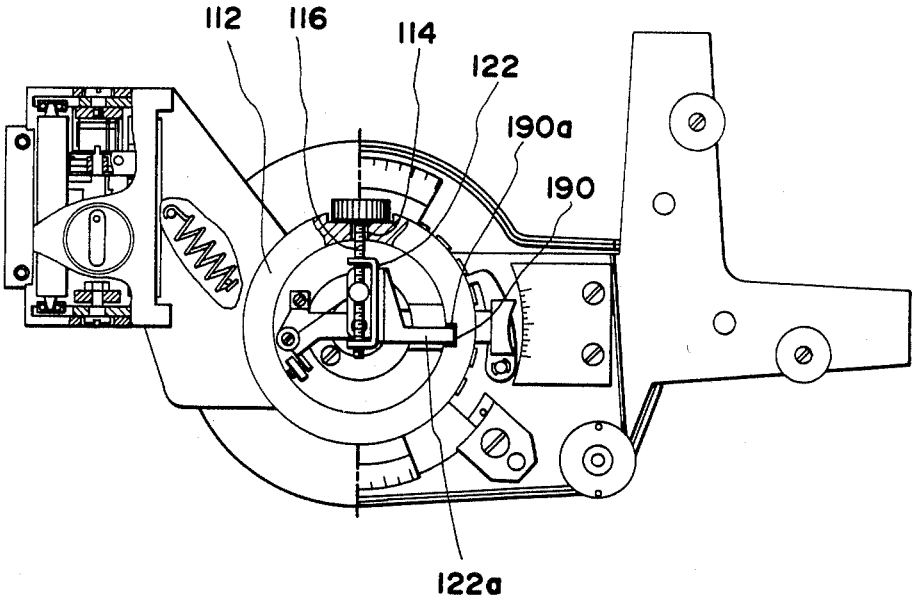
FIG. 14 is a plan view, partly in cross section, of a head according to a further embodiment of this invention.
Figure 15:
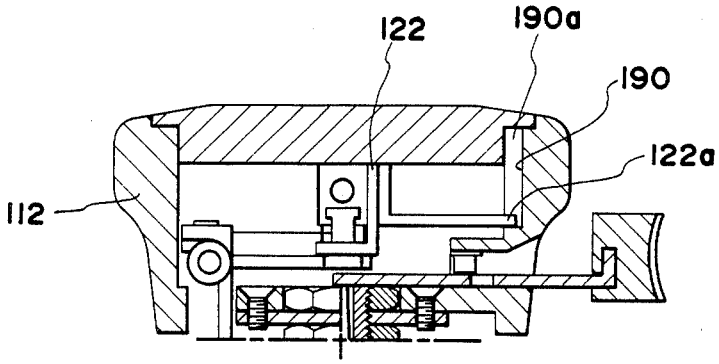
FIG. 15 is a cross section of an essential part of the head of FIG. 14.
Figure 16:
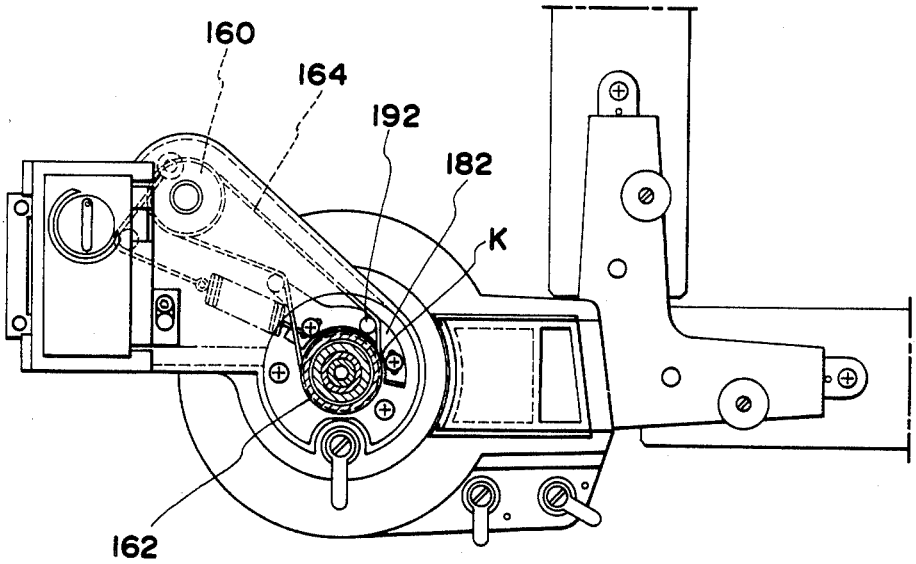
FIG. 16 is a plan view, partly in cross section, of a head according to a still further embodiment of this invention.
Figure 17:
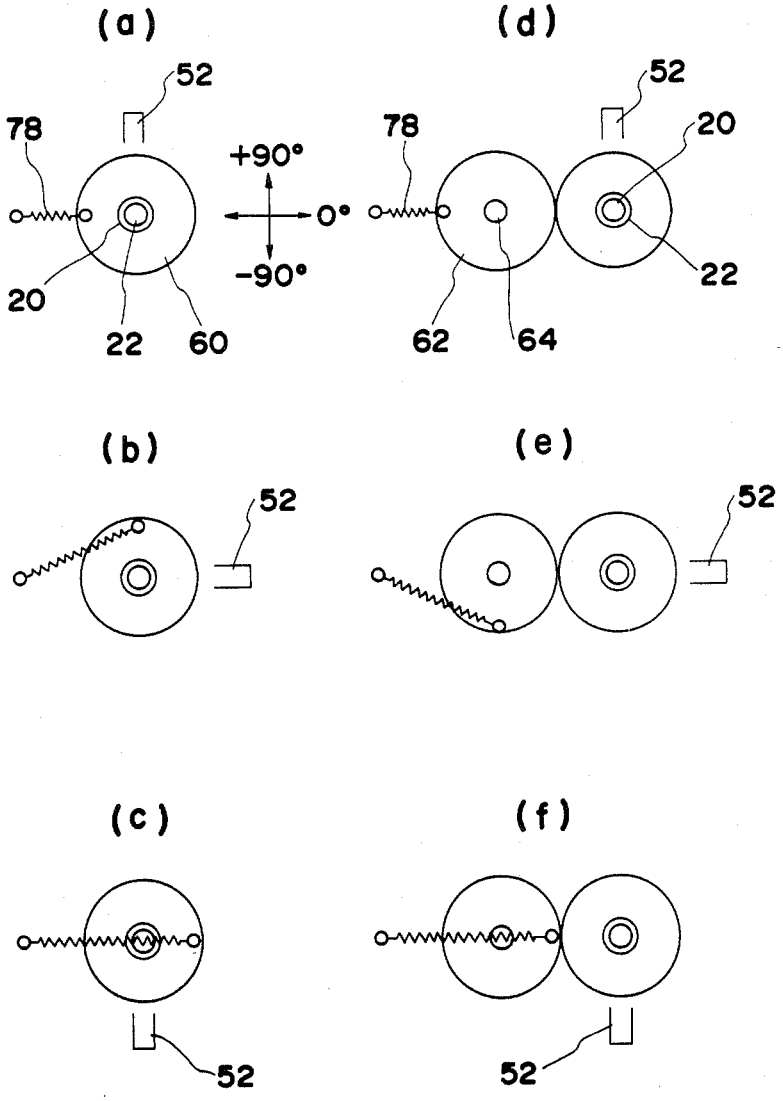
FIGS. 17*a*–17*c* are explanatory drawings explaining the principle of the present invention.
Figure 17A:
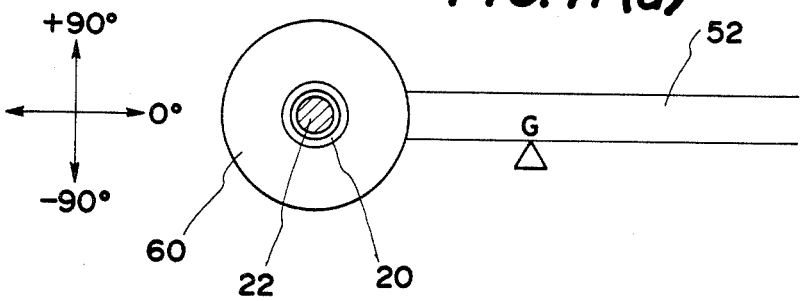
Figure 17B:
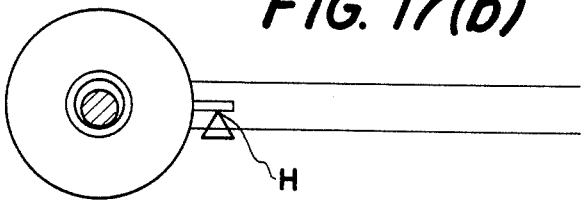
Figure 17C:
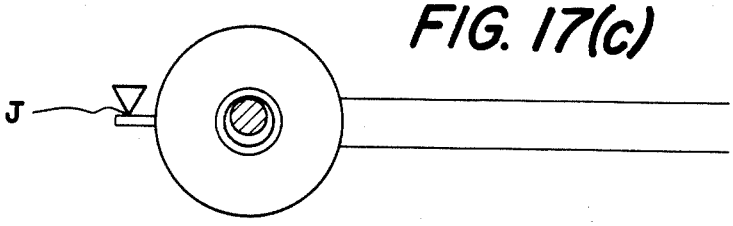

In FIG. 14 through FIG. 16, an embodiment of the invention is disclosed in which the point of engagement of the second rotating member and the rotating member is set in the vicinity of the point of center of gravity at the side of the first rotating member. In FIG. 14 and FIG. 15, numeral 122*a* denotes an arm projecting from the second rotating member 122, and one side of the tip of the arm 122*a* abuts on the handle 112 (rotating member) when the scale 52 is in parallel condition with the horizontal rail 4, and in FIG. 14, it abuts and engages on a surface 190*a* of a concave recess 190 formed at the right side of the handle 112 and parallel with horizontal rail 4, namely, toward the center of gravity at the side of the rotating member as discussed in connection with FIGS. 17*a*–17*c*. The abutted portion of the surface 190*a* and one side of the arm 122*a* forms an engaging point of the rotating members 112 and 122. The hole 114 formed in the handle 112 is larger in diameter than the hole of the embodiment illustrated in FIG. 7, and a gap is formed between the hole 114 and the shaft 116. The construction of other portions is identical with the construction illustrated in FIG. 7. In FIG. 16, numeral 192 denotes a belt pulley mounted rotatably on the bracket 182, and in FIG. 16, one end K of the timing belt 164 is guided so as to leave the rotating member 162 at right side in FIG. 16 of the rotating member 162, i.e. the point at which the scale 52 is almost in a horizontal position parallel the horizontal rail 4, namely, toward the point of center of gravity at the side of the rotating member 162 as discussed in connection with FIGS. 17*a*–17*c*. The end K is the effective point where the rotating members 160 and 162 are engaged. The construction of other portions is identical with the structure of the head illustrated in FIG. 12 and FIG. 13.

What is claimed is:

1. A scale balancing device for balancing the weight of a scale of a universal parallel ruler, said device comprising a head structure having a rotating scale support rotatably mounted thereon on which said scales are carried, said scale support and scales having a center of gravity when the scale is horizontal spaced horizontally from the axis of rotation of said scale support, a rotating member rotatably mounted on said head structure separate from said rotating support, means rotatably interlocking said rotating member and said scale support, an eccentric member on said rotating member, a spring member having one end connected to said eccentric member and the other end connected to said head structure and tensioned for providing a torque on said rotating member in a direction which substantially cancels out the torque on said rotating member from the weight of the scales, the point of interlocking of said rotating member and said scale support being on the side of said scale support toward the center of gravity when the scale is in the horizontal position for causing the point of action of the torque from said rotating member to act upwardly at a point toward the center of gravity from the axis of rotation of said scale support.

2. A scale balancing device as claimed in claim 1 in which said rotating member is spaced laterally of said scale support and said device further comprises a belt means connected between said rotating member and said scale support, said belt means extending away from the periphery of said scale support in a vertically upward direction on the side toward the position of said scale when said scale is in the horizontal position.

3. A scale balancing device as claimed in claim 2 in which said rotating member is coaxial with said scale support, and has an arm projecting therefrom toward the position of the center of gravity when the scale is in the horizontal position, the end of said arm engaging said scale support.

* * * * *